US006823830B2

(12) United States Patent
Azuma

(10) Patent No.: US 6,823,830 B2
(45) Date of Patent: Nov. 30, 2004

(54) CYLINDER DISABLING CONTROL APPARATUS FOR A MULTI-CYLINDER ENGINE

(75) Inventor: Tadahiro Azuma, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/155,983

(22) Filed: May 29, 2002

(65) Prior Publication Data

US 2003/0089330 A1 May 15, 2003

(30) Foreign Application Priority Data

Nov. 14, 2001 (JP) ..... 2001-348373

(51) Int. Cl.[7] ..... F02B 77/08
(52) U.S. Cl. ..... 123/198 F; 123/198 DB
(58) Field of Search ..... 123/198 F, 198 DB, 123/41.05

(56) References Cited

U.S. PATENT DOCUMENTS 4,494,503 A * 1/1985 Danno et al. ..... 123/198 F
4,608,952 A * 9/1986 Morita et al. ..... 123/198 F
5,568,795 A * 10/1996 Robichaux et al. ..... 123/198 F
5,653,102 A * 8/1997 Orzel et al. ..... 123/198 F
5,826,563 A * 10/1998 Patel et al. ..... 123/198 F
5,970,943 A * 10/1999 Robichaux et al. ..... 123/198 F
6,125,812 A * 10/2000 Garabedian ..... 123/198 F
6,244,258 B1 * 6/2001 Akiyama et al. ..... 123/198 F
6,305,344 B1 * 10/2001 Perry ..... 123/198 F
6,546,910 B2 * 4/2003 Tanaka et al. ..... 123/198 F

FOREIGN PATENT DOCUMENTS

JP 10-169479 6/1998

* cited by examiner

*Primary Examiner*—Henry C. Yuen
*Assistant Examiner*—Jason Benton
(74) *Attorney, Agent, or Firm*—Sughrue Mion, PLLC

(57) ABSTRACT

A cylinder disabling control apparatus for a multi-cylinder engine is provided which is capable of efficiently reducing the exhaust gas of the engine immediately after the starting thereof. The cylinder disabling control apparatus includes a variety of sensors (2, 3, 12–14, and 16), a catalytic converter (17) and a cylinder disabling control element (21) for inhibiting or stopping fuel supplied to the at least one specific cylinder in accordance with the engine operating conditions. The variety of sensors includes a water temperature sensor (14) for detecting a temperature of cooling water (WT). When the temperature (WT) upon starting of the engine 6 is equal to or higher than a first predetermined temperature (WT1), the cylinder disabling control element (21) performs cylinder disabling control on the at least one specific cylinder until a predetermined time has elapsed immediately after the starting of the engine (6).

22 Claims, 5 Drawing Sheets

IN CASE OF L-4 CYLINDERS
(ORDER OF IGNITIONS: #1→#3→#4→#2)

· SELECTION MODES
FOR TWO CYLINDERS TO BE DISABLED
(1) #1 + #4 (2) #2 + #3

IN CASE OF V-6 CYLINDERS
(ORDER OF IGNITIONS: #1→#2→#3→#4→#5→#6)

· SELECTION MODES
FOR TWO CYLINDERS TO BE DISABLED
(1) #1 + #4 (2) #2 + #5 (3) #3 + #6

CYLINDER DISABLING CONTROL APPARATUS FOR A MULTI-CYLINDER ENGINE

This application is based on application Ser. No. 2001-348373, filed in Japan on Nov. 14, 2001, the contents of which are hereby incorporated by reference.

BACKGROUND OF THE INVENTION

1. Field of the Invention

The present invention relates to a cylinder disabling control apparatus of a multi-cylinder engine which has a catalytic converter for purifying exhaust gas, and more specifically, it relates to a cylinder disabling control apparatus for a multi-cylinder engine which is capable of efficiently controlling disabled or stopped cylinders immediately after starting of the engine until a catalyst in the catalytic converter is activated (i.e., until a predetermined time has elapsed) according to the temperature of engine cooling water at the time of the engine starting.

2. Description of the Prior Art

Conventionally, a variety of cylinder disabling or cut-off control apparatuses for multi-cylinder engines have been proposed which, for the purpose of improving fuel economy, perform cylinder disabling control (i.e., some of cylinders being stopped or disabled) in accordance with the operating conditions of an engine (e.g., a warm up condition) thereby to save and reduce the amount of injected fuel, as disclosed for example in Japanese Patent Application Laid-Open No. 10-169479, etc.

On the other hand, environmental problems have gotten a lot of attention in recent years, and exhaust emissions control on engines is becoming severe year by year, too.

Thus, in order to cope the exhaust emissions control, technologies for postprocessing exhaust gas with a catalytic converter (hereinafter, also simply referred to as a "catalyst") are making great advances.

Today, exhaust gas after a catalyst has been activated can be purified substantially to a satisfactory extent, but it is difficult to reduce the amount of harmful or untreated components in the exhaust gas during a period of time immediately after starting of an engine until the catalyst is activated, thus giving rise to a big problem. In particular, the greater the displacement of the engine, the greater becomes the importance of a demand for purifying the exhaust gas at the time of engine starting.

With the known cylinder disabling control apparatuses for multi-cylinder engines, exhaust gas can be satisfactorily purified after the activation of the catalyst, however, there has been a problem that exhaust gas could not be purified for a period of time after starting of an engine until the catalyst is activated, so the exhaust emissions control or regulations stipulated by governments in advanced countries could not be cleared or satisfied immediately after the engine starting.

SUMMARY OF THE INVENTION

The present invention is intended to solve the problem as referred to above, and to this end, special attention has been paid to the fact that there will be no problem in terms of driver's feeling even if cylinder disabling control is effected (i.e., some of cylinders are stopped or disabled) at a time such as an engine starting period, idling time and the like in which required torque of the engine is comparatively limited. Accordingly, in view of this fact, the object of the present invention is to provide a cylinder disabling control apparatus for a multi-cylinder engine which is capable of efficiently reducing the engine exhaust gas and hence harmful components contained therein immediately after starting of the engine by performing cylinder disabling control for a period of time in which a catalyst in a catalytic converter is in an inactivated state.

Bearing the above object in mind, there is provided a cylinder disabling control apparatus for a multi-cylinder engine including: a variety of sensors for detecting operating conditions of an engine having a plurality of cylinders; a catalytic converter for purifying exhaust gas of the engine; and a cylinder disabling control means for performing cylinder disabling control on at least one specific cylinder among the plurality of cylinders by inhibiting fuel supplied to the at least one specific cylinder in accordance with the engine operating conditions. The variety of sensors includes a water temperature sensor for detecting a temperature of cooling water of the engine. When the temperature of cooling water upon starting of the engine is equal to or higher than a first predetermined temperature, the cylinder disabling control means performs cylinder disabling control on the at least one specific cylinder immediately after the starting of the engine until a predetermined time has elapsed.

Therefore, a cylinder disabling control apparatus for a multi-cylinder engine which is capable of efficiently reducing the engine exhaust gas at a time such as an engine starting period can be provided.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings.

Embodiment 1

Figure 1:
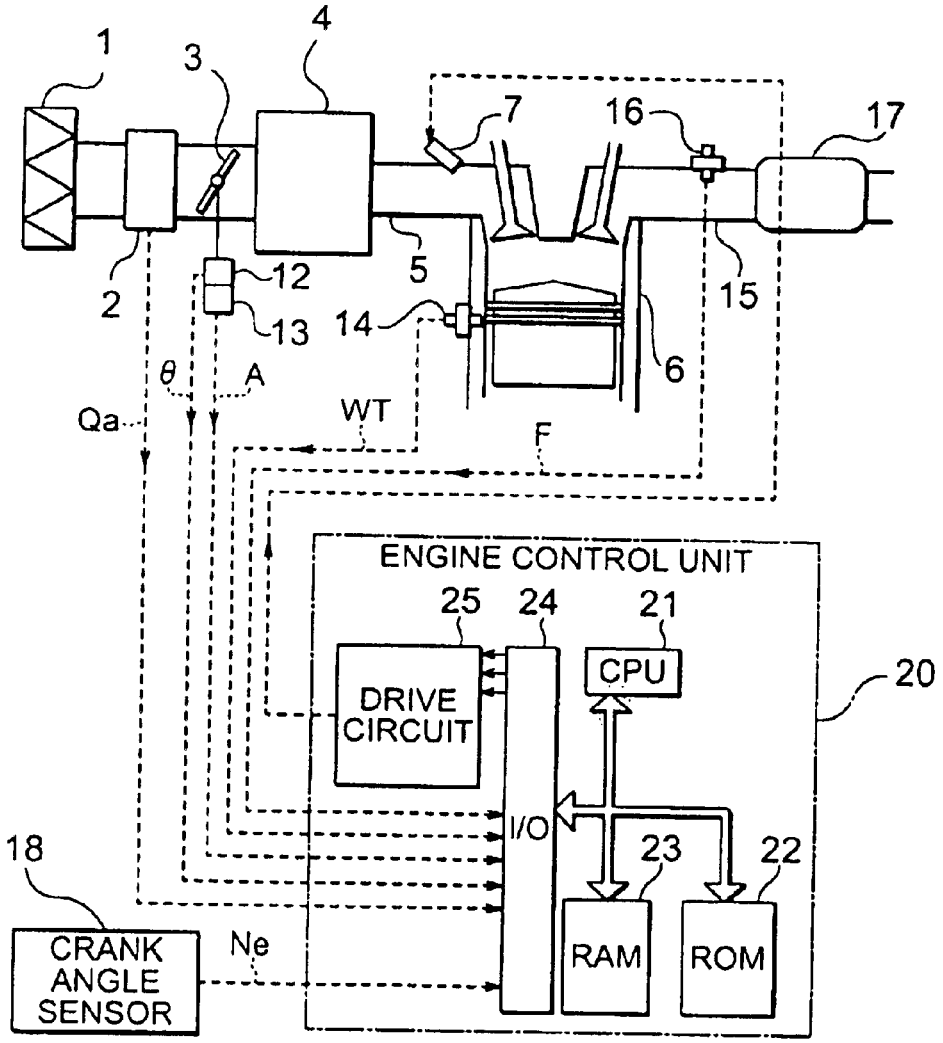
FIG. 1 is a block diagram illustrating a cylinder disabling control apparatus for a multi-cylinder engine according to a first embodiment of the present invention.

First, reference will be made to a first embodiment of the present invention. FIG. 1 is a block diagram which shows a cylinder disabling control apparatus for a multi-cylinder engine constructed in accordance with the first embodiment of the present invention.

In FIG. 1, air sucked into an intake pipe 5 through an air cleaner 1 is measured as an amount of intake air Qa by means of an air flow sensor 2.

The amount of intake air Qa is controlled by a throttle valve 3 in accordance with an engine load, and sucked into respective cylinders of an engine proper 6 (hereinafter, simply referred to as an engine) through a surge tank 4 and the intake pipe 5.

On the other hand, fuel is injected into the intake pipe 5 through an injector 7, so that it is mixed with the intake air to form an air fuel mixture, which is then supplied to the respective cylinders of the engine 6.

A throttle sensor 12 detects the opening degree of the throttle valve 3 and generates an output signal representative of the detected throttle opening θ, and an idle switch 13 generates an idle signal A which turns on or in a high level when the throttle opening θ is at an idling opening degree (i.e., θ=0).

A water temperature sensor 14 detects the temperature of cooling water WT to generate a corresponding signal, and an air fuel ratio sensor 16 mounted on an exhaust pipe 15 detects the air/fuel ratio of the mixture and generates an air fuel ratio feedback signal F. A catalytic converter 17 containing a catalyst therein is provided at the downstream side of the exhaust pipe 15 for purifying the exhaust gas therein.

Though not shown in the drawings, an oxygen sensor and a second catalytic converter are generally arranged at the downstream side of the catalytic converter 17.

A crank angle sensor 18 generates a pulse signal at each reference rotational position of a crankshaft (not shown) of the engine 6 thereby to detect the number of revolutions per minute of the engine Ne.

An engine control unit 20 is constituted by a microcomputer, and includes a CPU 21, a ROM 22, a RAM 23, an I/O interface 24 and a driving circuit 25.

The engine control unit 20 takes in information on the operating conditions of the engine 6 (the amount of intake air Qa, the throttle opening θ, the idle signal A, the temperature of cooling water WT, the air fuel ratio feedback signal F, and the number of revolutions per minute of the engine Ne, etc.) through the I/O interface 24.

The CPU 21 in the engine control unit 20 decides fuel injection timing, the amount of fuel to be injected, etc., by performing various control calculations in accordance with the input information (engine operating conditions) based on control programs and various kinds of maps stored in the ROM 22, and drives the injector 7 through the driving circuit 25.

Moreover, the CPU 21 is provided with a cylinder disabling control means for inhibiting or stopping the supply of fuel to a specific one of a plurality of cylinders in accordance with the engine operating conditions. Specifically, when it is indicated that the temperature of cooling water WT at the time of starting of the engine 6 is equal to or higher than a first predetermined temperature WT1 (for instance, a value in the range of from −10° C. to 40° C.), the cylinder disabling control means controls a specific cylinder to disable or stop the operation thereof until a predetermined time τ (i.e., corresponding to a period of time required to activate the catalytic converter 17) has elapsed immediately after the engine starting.

Next, reference will be made to a concrete processing operation for the cylinder disabling control carried out in accordance with the first embodiment of the present invention shown in FIG. 1 while referring to a flow chart of FIG. 2.

Figure 2:
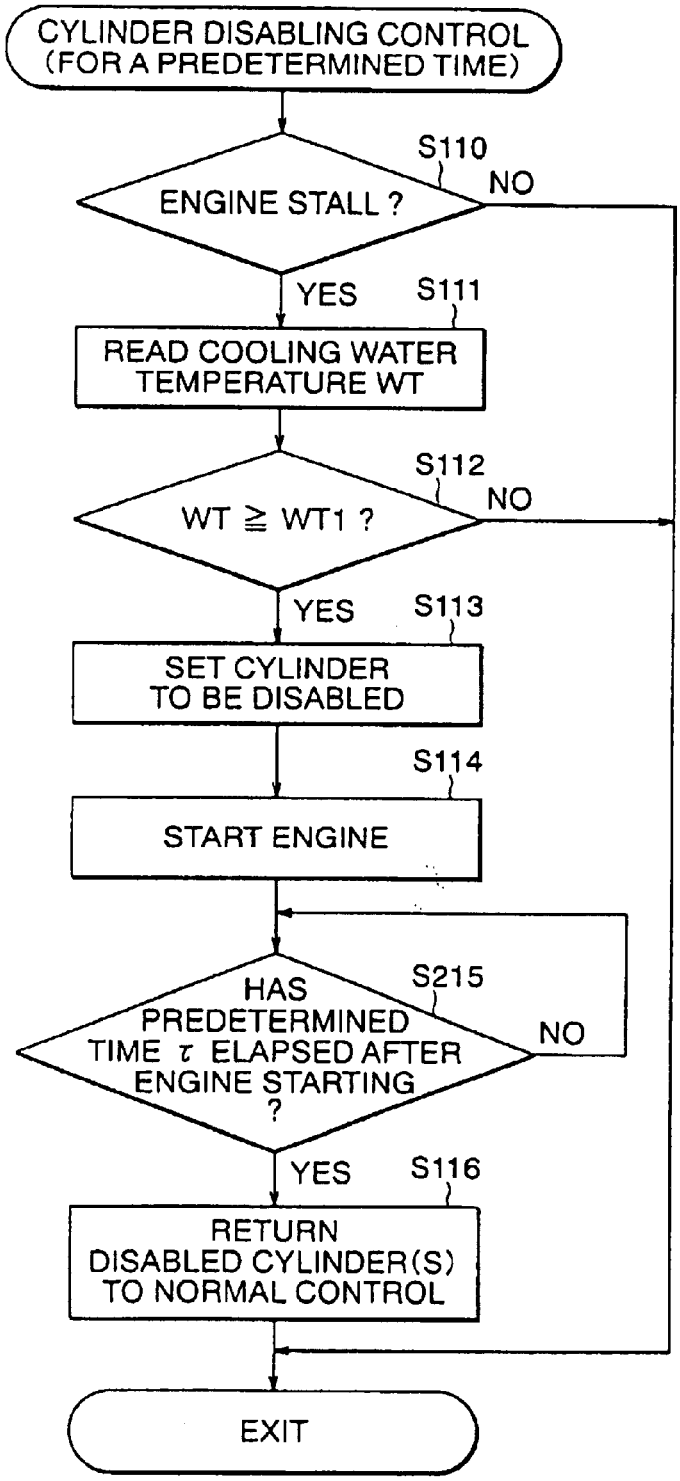
FIG. 2 is a flow chart illustrating a cylinder disabling control operation carried out by the first embodiment of the present invention.

In FIG. 2, the CPU 21 (cylinder disabling control means) determines whether the engine 6 is in a stopped state (engine stall)(step S110).

When it is determined in step S110 that the engine 6 is not in a stopped state (that is, NO), the processing routine of FIG. 2 is ended without performing cylinder disabling control, whereas the engine 6 is determined to be in a stopped state (that is, YES), the temperature of cooling water WT for the engine 6 is read in.

Then, it is determined in step S112 whether the temperature of cooling water WT is equal to or higher than the first predetermined temperature WT1, and when it is determined as WT<WT1 (that is, NO), it is considered that the friction of the engine 6 is large and hence it is impossible to perform cylinder disabling control, and hence the processing routine of FIG. 2 is ended without performing the cylinder disabling control.

On the other hand, when it is determined as WT≧WT1 in step S112 (that is, YES), a specific cylinder, on which cylinder disabling control is carried out, is set (step S113), and the engine 6 is started (step S114).

At this time, in order to prevent the deterioration of startability of the engine 6, the cylinder to be first ignited is excluded from the specific cylinder to be disabled or stopped.

Subsequently, the time elapsed after the engine 6 has been started is managed or measured, and it is determined whether the predetermined time τ has passed from the engine starting (step S115).

When it is determined in step S115 that the predetermined time τ has passed after the engine starting (that is, YES), the disabled or stopped cylinder is returned to a normal or ordinary operation (step S116), and the cylinder disabling control routine of FIG. 2 is ended.

Thus, it is possible to reduce the amount of fuel required for a period immediately after starting of the engine until the predetermined time τ has passed, by performing the cylinder disabling control (e.g., stopping the injection of fuel) over the predetermined time τ after the engine starting.

Accordingly, the exhaust gas (in particular, uncombusted fuel gas components HC) discharged from the engine 6 is reduced, so it is possible to prevent the deterioration of the exhaust gas even if the catalytic converter 17 is not activated.

In addition, at this time, it is possible to avoid a marked deterioration of startability of the engine, by excluding at least the cylinder, in which fuel is to be first fired to combust upon engine starting, from the specific cylinder on which the cylinder disabling control is effected.

Moreover, it is also possible to avoid forced cylinder disabling control during cold starting of the engine (i.e., in case of WT<WT1 where the friction of the engine 6 due to engine oil is large).

Embodiment 2

Although in the above-mentioned first embodiment, the engine is returned from cylinder disabling control to normal or ordinary control at the time when the predetermined time τ has passed, without taking account of the temperature of the catalytic converter 17, such returning from the cylinder disabling control to the normal or ordinary control may be effected at a time after the temperature of the catalytic converter 17 has reached its activation temperature.

Figure 3:
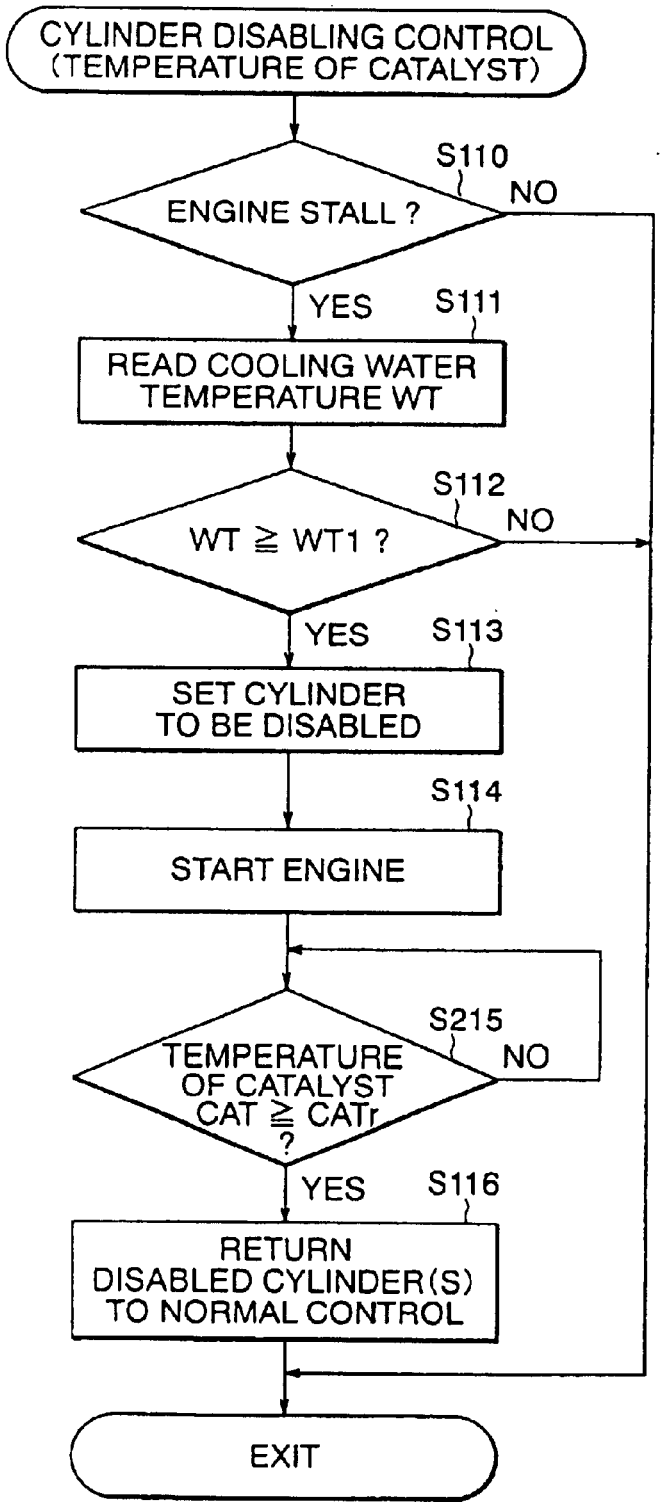
FIG. 3 is a flow chart illustrating a cylinder disabling control operation carried out by a second embodiment of the present invention.

FIG. 3 is a flow chart which shows a cylinder disabling control operation in which consideration is given to the temperature of the catalytic converter 17, according to a second embodiment of the present invention. In this figure, processing steps similar to those as mentioned above (see FIG. 2) are identified by the same symbols and a detailed description thereof is omitted.

In this second embodiment, a cylinder disabling control means (CPU 21) includes a catalyst temperature estimation means for estimating the temperature of the catalytic converter or the temperature of a catalyst CAT based on the temperature of cooling water WT, the amount of intake air Qa, and the number of revolutions per minute of the engine Ne, and a return means for deciding return timing to return a specific cylinder from its disabled or stopped state to a normal operation state depending upon the temperature of catalyst CAT.

The return means in the cylinder disabling control means decides the return timing after the temperature of catalyst CAT has reached its activation temperature CATr or higher.

In FIG. 3, the aforementioned steps S110–S114 are first carried out as in the first embodiment, so that when the temperature of cooling water WT upon engine starting is equal to or higher than the first predetermined temperature WT1, a cylinder to be disabled or stopped is set.

Then, after starting of the engine 6, the catalyst temperature estimation means in the CPU 21 estimates the temperature of catalyst CAT, and the return means determines whether the temperature of catalyst CAT has reached the activation temperature CATr or higher (step S215).

When it is determined as CAT≧CATr in step S215 (that is, YES), the return means decides the return timing and returns the disabled or stopped cylinder to the normal operation (step S216), and the cylinder disabling control routine of FIG. 3 is ended.

Thus, by deciding the return timing from the cylinder disabling control to the normal control after engine starting in accordance with the temperature of catalyst CAT, the cylinder disabling control can be promptly released or stopped when it is estimated that the catalytic converter 17 is in an activated state.

Additionally, the cylinder disabling control is performed only for a minimum period required to achieve a cylinder disabling effect, and after the catalytic converter 17 has been activated, the engine 6 is promptly shifted to the optimal normal control. As a result, the exhaust gas can be efficiently reduced during the engine starting period.

Here, note that though the temperature of catalyst CAT has been estimated by the catalyst temperature estimation means in the CPU 21, a temperature sensor (not shown) may be provided on the catalytic converter 17 for directly detecting the temperature of catalyst CAT.

In this case, it becomes unnecessary to use the catalyst temperature estimation means, and the return means in the CPU 21 takes in an output signal (the temperature of catalyst CAT) from this temperature sensor, compares it with the activation temperature CATr, and decides the return timing.

Embodiment 3

Although it is assumed in the above-mentioned first and second embodiments that the specific cylinder to be disabled or stopped is a single cylinder, when the temperature of cooling water WT upon engine starting is comparatively high (i.e., at about a warm up temperature of the engine 6) in which the friction caused by engine oil is limited, a plurality of cylinders may be subjected to the cylinder disabling control.

Figure 4:
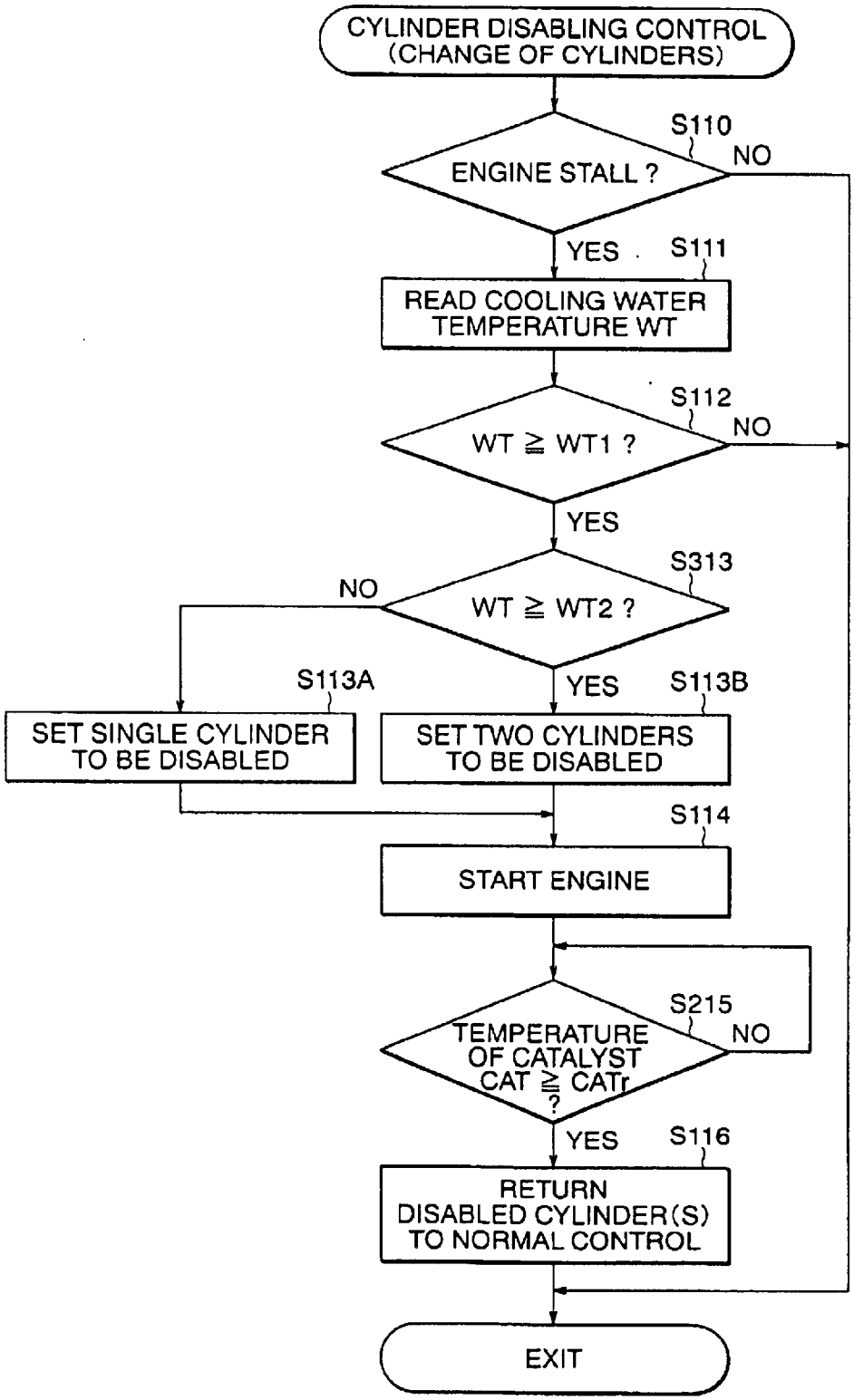
FIG. 4 is a flow chart illustrating a cylinder disabling control operation carried out by a third embodiment of the present invention.

FIG. 4 is a flow chart which shows a cylinder disabling control operation carried out by a third embodiment of the present invention, in which a plurality of cylinders can be disabled or stopped. In the following description, processing steps of this third embodiment similar to those described above (see FIG. 2 and FIG. 3) are identified by the same symbols or with "A" and "B" being affixed after the same symbols while omitting a detailed explanation thereof.

Figure 5:
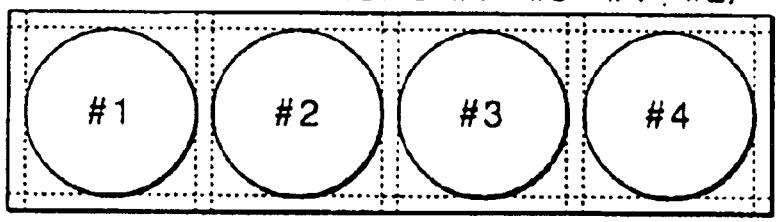
FIG. 5 is an explanatory view illustrating combinations of disabled or stopped cylinders in an L-4 engine in accordance with the third embodiment of the present invention.
Figure 6:
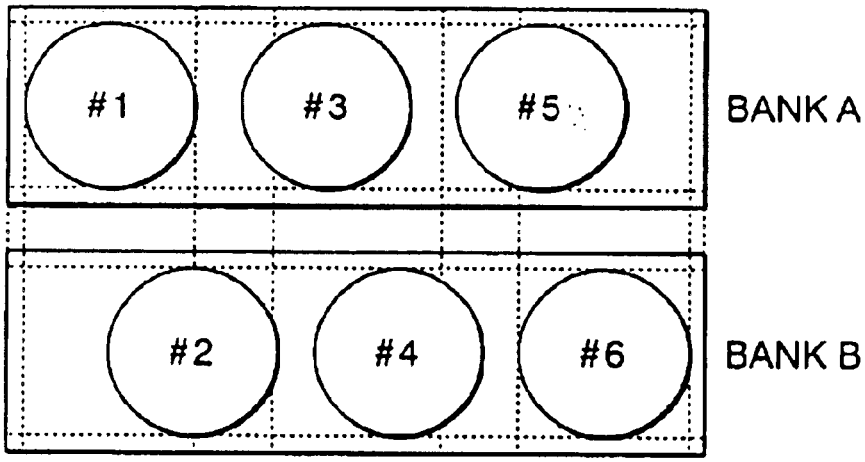
FIG. 6 is an explanatory view illustrating combinations of disabled or stopped cylinders in a V-6 engine in accordance with the third embodiment of the present invention.

Also, FIG. 5 and FIG. 6 are explanatory views which show selection modes for two cylinders on which cylinder disabling control is carried out, wherein FIG. 5 shows selection modes in an L-4 cylinder engine having four cylinders arranged in a line, and FIG. 6 shows selection modes in a V-6 cylinder engine having six cylinders arranged in a V shape or type.

In this case, when it is indicated that the temperature of cooling water WT upon engine starting is equal to or higher than a second predetermined temperature WT2 (corresponding to a warm up temperature of the engine 6) which is higher than the first predetermined temperature WT1, the cylinder disabling control means (CPU 21) performs cylinder disabling control on two or more cylinders.

Moreover, when a plurality of cylinders of the V type engine are subjected to cylinder disabling control, the cylinder disabling control means makes a decision such that the plurality of cylinders to be disabled or stopped are arranged substantially evenly on the opposite (right and left) banks of the V type.

In addition, the cylinders to be disabled are decided such that the plurality of cylinders are not successively disabled or stopped.

In FIG. 4, first, in the above-mentioned steps S110 through S112, the temperatures of cooling water WT upon engine starting is compared with the first predetermined temperature WT1.

When it is determined as WT≧WT1 in step S112 (that is, YES), a further determination is then made as to whether the temperature of cooling water WT upon engine starting is equal to or higher than the second predetermined temperature WT2 (step S313).

That is, the friction of the engine 6 is estimated from the temperature of cooling water WT upon engine starting, and the number of cylinders to be disabled is set to one or two or more cylinders depending upon whether the temperature of cooling water WT is less than or not less than the second predetermined temperature WT2.

When it is determined as WT<WT2 in step S313 (that is, NO), the engine 6 upon starting thereof is not in a warm up state, and hence only a single cylinder is set as the cylinder to be disabled (step S113A), and the control routine proceeds to an engine starting step S114.

On the other hand, when it is determined as WT≧WT2 in step S313 (that is, YES), it is considered that the engine 6 upon starting thereof is in a warm up state (i.e., immediately after the last engine stop), and hence two (or three or more) cylinders are set as the cylinders to be disabled (step S113B), and the control routine proceeds to the engine starting step S114.

When two cylinders are subjected to the cylinder disabling control for instance, in case of the L-4 cylinder engine (see FIG. 5), either of the following combinations (1) and (2) of cylinders #1 through #4 is selected:

(1) a combination of cylinder #1 and cylinder #4; and (2) a combination of cylinder #2 and cylinder #3.

Also, in case of the V-6 cylinder engine (see FIG. 6), either one of the following combinations (3), (4) and (5) of cylinders #1 through #6 is selected:

(3) a combination of cylinder #1 and cylinder #4;

(4) a combinations of cylinder #2 and cylinder #5; and (5) a combinations of cylinder #3 and cylinder #6.

By selecting two cylinders to be disabled in such a manner as shown in FIG. 5 or FIG. 6, it can be avoided that the cylinders to be disabled are localized on a one-side bank alone in case of the V-6 type engine, and in addition, it can also be avoided that a plurality of cylinders are controlled to be successively disabled irrespective of the type of the engine 6.

Thereafter, as described in the foregoing embodiments, the cylinder disabling control is released or stopped when the temperature of catalyst CAT reaches the activation temperature CATr after starting of the engine 6 (or, when the predetermined time $\tau$ has elapsed), and the engine is returned to the normal or ordinary control.

In this manner, by further subdividing the state of the friction of the engine 6 depending upon the temperature of cooling water WT and making appropriate determinations using the engine frictional state thus subdivided, it is possible to selectively perform cylinder disabling control on a single cylinder or two or more cylinders, so that the number of cylinders to be disabled can be variably set in an optimal manner.

Therefore, the cylinder disabling control can be efficiently performed in accordance with the load of the engine 6, thus making it possible to further reduce the exhaust gas during a period immediately after starting of the engine 6 until the catalytic converter 17 is activated.

In addition, though the V-6 type engine has the catalytic converter 17 arranged on each bank, a plurality of cylinders to be disabled are not localized on a one-side bank, so the temperatures of the catalytic converters 17 on the opposite banks can be increased to the activation temperature CATr at the same time during the cylinder disabling control.

Accordingly, it is possible to avoid adverse effects on rising in the temperature of catalyst CAT during the cylinder disabling control, and hence, the respective catalytic converters 17 corresponding to the opposite banks can be activated in a reliable manner when the engine 6 is returned from the cylinder disabling control to the normal or ordinary control. As a consequence, the exhaust gas discharged from a tail pipe can be reduced efficiently.

Moreover, by preventing a plurality of cylinders from being successively disabled or stopped, driver's feeling during idling is not worsened to any practical extent.

Here, note that the cylinder disabling control means may sequentially carry out cylinder disabling control on a plurality of cylinders by periodically switching between modes for selecting a plurality of cylinders to be disabled, so that a single cylinder can be prevented from being successively subjected to the cylinder disabling control. As a result, it is possible to further stabilize the operating state of the engine 6 during the cylinder disabling control.

While the invention has been described in terms of preferred embodiments, those skilled in the art will recognize that the invention can be practiced with modifications within the spirit and scope of the appended claims.

Effect

According to the present invention, there is provided a cylinder disabling control apparatus for a multi-cylinder engine including: a variety of sensors for detecting operating conditions of an engine having a plurality of cylinders; a catalytic converter for purifying exhaust gas of the engine; and a cylinder disabling control means for performing cylinder disabling control on at least one specific cylinder among the plurality of cylinders by inhibiting fuel supplied to the at least one specific cylinder in accordance with the engine operating conditions; wherein, the variety of sensors includes a water temperature sensor for detecting a temperature of cooling water of the engine, and when the temperature of cooling water upon starting of the engine is equal to or higher than a first predetermined temperature, the cylinder disabling control means performs cylinder disabling control on the at least one specific cylinder immediately after the starting of the engine until a predetermined time has elapsed. Therefore, a cylinder disabling control apparatus for a multi-cylinder engine which is capable of efficiently reducing the engine exhaust gas at a time such as an engine starting period can be provided.

Additionally, according to the present invention, there is provided a cylinder disabling control apparatus for a multi-cylinder engine, wherein the variety of sensors includes an air flow sensor for detecting an amount of intake air sucked into the engine, and a crank angle sensor for detecting the number of revolutions per minute of the engine, and the cylinder disabling control means includes: catalyst temperature estimation means for estimating a temperature of the catalytic converter based on the temperature of cooling water, the amount of intake air, and the number of revolutions per minute of the engine; and return means for deciding return timing for returning the at least one specific cylinder from a cylinder-disabled state to a normal state in accordance with the temperature of the catalytic converter; wherein the return means decides the return timing after the temperature of the catalytic converter has reached its activation temperature or higher. Therefore, a cylinder disabling control apparatus for a multi-cylinder engine which is capable of efficiently reducing the engine exhaust gas at a time such as an engine starting period can be provided, since the cylinder disabling control is performed only for a minimum period required to achieve a cylinder disabling effect.

Additionally, according to the present invention, there is provided a cylinder disabling control apparatus for a multi-cylinder engine, wherein the cylinder disabling control means performs cylinder disabling control on two or more cylinders when the temperature of cooling water upon engine starting is equal to or higher than a second predetermined temperature which is higher than the first predetermined temperature. Therefore, a cylinder disabling control apparatus for a multi-cylinder engine which is capable of efficiently reducing the engine exhaust gas at a time such as an engine starting period can be provided, since the number of cylinders to be disabled can be variably set using the engine frictional state.

Additionally, according to the present invention, there is provided a cylinder disabling control apparatus for a multi-cylinder engine, wherein the respective cylinders of the engine are arranged on opposite banks of V type, and in case of the two or more cylinders being subjected to cylinder disabling control, the cylinder disabling control means decides cylinders to be disabled in such a manner that the cylinders to be disabled are distributed substantially evenly to the opposite banks of V type. Therefore, a cylinder disabling control apparatus for a multi-cylinder engine which is capable of efficiently reducing the engine exhaust gas at a time such as an engine starting period can be provided, without impairment of the capability to effect on rising in the temperature of catalyst during the cylinder disabling control.

Additionally, according to the present invention, there is provided a cylinder disabling control apparatus for a multi-cylinder engine, wherein in case of the two or more cylinders being subjected to cylinder disabling control, the cylinder disabling control means decides the cylinders to be disabled in such a manner that the two or more cylinders to be disabled are not successively subjected to the cylinder disabling control. Therefore, a cylinder disabling control apparatus for a multi-cylinder engine which is capable of efficiently reducing the engine exhaust gas at a time such as an engine starting period can be provided, without impairment of the capability of driver's feeling even if cylinder disabling control is effected.

Additionally, according to the present invention, there is provided a cylinder disabling control apparatus for a multi-cylinder engine, wherein the cylinder disabling control means excludes a cylinder, in which fuel is to be first fired to combust upon engine starting, at least from a specific cylinder that is first subjected to the cylinder disabling control. Therefore, a cylinder disabling control apparatus for a multi-cylinder engine which is capable of preventing the situation of becoming worse of engine starting performance.

What is claimed is:

1. A cylinder disabling control apparatus for a multi-cylinder engine comprising:

a variety of sensors for detecting operating conditions of an engine having a plurality of cylinders;

a catalytic converter for purifying exhaust gas of said engine; and a cylinder disabling control means for performing cylinder disabling control on at least one specific cylinder among said plurality of cylinders by inhibiting fuel supplied to the at least one specific cylinder in accordance with the engine operating conditions;

wherein said variety of sensors includes a water temperature sensor for detecting a temperature of cooling water of said engine; and when the temperature of cooling water upon starting of said engine is equal to or higher than a first predetermined temperature, said cylinder disabling control means performs cylinder disabling control on said at least one specific cylinder immediately after the starting of said engine until a determined time has elapsed.

2. The cylinder disabling control apparatus for a multi-cylinder engine according to claim 1, wherein said determined time is set in accordance with a period of time required for activating said catalytic converter.

3. The cylinder disabling control apparatus for a multi-cylinder engine according to claim 1, wherein said variety of sensors includes an air flow sensor for detecting an amount of intake air sucked into said engine, and a crank angle sensor for detecting the number of revolutions per minute of said engine; and said cylinder disabling control means comprises:

catalyst temperature estimation means for estimating a temperature of said catalytic converter based on the temperature of cooling water, the amount of intake air, and the number of revolutions per minute of said engine; and return means for deciding return timing for returning said at least one specific cylinder from a cylinder-disabled state to a normal state in accordance with the estimated temperature of said catalytic converter;

wherein said return means decides said return timing after the estimated temperature of said catalytic converter has reached its activation temperature or higher.

4. The cylinder disabling control apparatus for a multi-cylinder engine according to claim 1, wherein said variety of sensors include a catalyst temperature sensor for detecting a temperature of said catalytic converter;

said cylinder disabling control means includes return means for deciding return timing for returning said at least one specific cylinder from its cylinder-disabled state to a normal state in accordance with the temperature of said catalytic convener; and said return means decides said return timing after the temperature of said catalytic converter has reached its activation temperature or higher.

5. The cylinder disabling control apparatus for a multi-cylinder engine according to claim 1, wherein said cylinder disabling control means performs cylinder disabling control on two or more cylinders when the temperature of cooling water upon engine starting is equal to or higher than a second predetermined temperature which is higher than said first predetermined temperature.

6. The cylinder disabling control apparatus for a multi-cylinder engine according to claim 5, wherein said second predetermined temperature is set in accordance with a warm up temperature of said engine.

7. The cylinder disabling control apparatus for a multi-cylinder engine according to claim 6, wherein the respective cylinders of said engine are arranged on opposite banks of V type, and in case of said two or more cylinders being subjected to cylinder disabling control, said cylinder disabling control means decides cylinders to be disabled in such a manner that said cylinders to be disabled are distributed substantially evenly to the opposite banks of V type.

8. The cylinder disabling control apparatus for a multi-cylinder engine according to claim 6, wherein in case of said two or more cylinders being subjected to cylinder disabling control, said cylinder disabling control means decides the cylinders to be disabled in such a manner that said two or more cylinders to be disabled are not successively subjected to the cylinder disabling control.

9. The cylinder disabling control apparatus for a multi-cylinder engine according to claim 6, wherein in case of said two or more cylinders being subjected to cylinder disabling control, said cylinder disabling control means prevents a single cylinder from being successively subjected to the cylinder disabling control, by sequentially disabling said two or more cylinders.

10. The cylinder disabling control apparatus for a multi-cylinder engine according to claim 1, wherein said cylinder disabling control means excludes a cylinder, in which fuel is to be first fired to combust upon engine starting, at least from a specific cylinder that is first subjected to the cylinder disabling control.

11. A cylinder disabling control apparatus for a multi-cylinder engine comprising:

a variety of sensors which detect operating conditions of an engine having a plurality of cylinders;

a catalytic converter for purifying exhaust gas of said engine; and a cylinder disabling control circuit which performs cylinder disabling control on at least one specific cylinder among said plurality of cylinders by inhibiting fuel supplied to the at least one specific cylinder in accordance with the engine operating conditions;

wherein said variety of sensors includes a water temperature sensor for detecting a temperature of cooling water of said engine; and when the temperature of cooling water upon starting of said engine is equal to or higher than a first predetermined temperature, said cylinder disabling control circuit performs cylinder disabling control on said at least one specific cylinder immediately after the starting of said engine until a determined time has elapsed.

12. The cylinder disabling control apparatus for a multi-cylinder engine according to claim 11, wherein said determined time is set in accordance with a period of time required for activating said catalytic converter.

13. The cylinder disabling control apparatus for a multi-cylinder engine according to claim 11, wherein said variety of sensors includes an air flow sensor for detecting an amount of intake air sucked into said engine, and a crank angle sensor for detecting the number of revolutions per minute of said engine; and said cylinder disabling control circuit comprises:

a catalyst temperature estimation circuit for estimating a temperature of said catalytic converter based on the temperature of cooling water, the amount of intake air, and the number of revolutions per minute of said engine; and a return circuit which decides return timing for returning said at least one specific cylinder from a cylinder-disabled state to a normal state in accordance with the temperature of said catalytic converter;

wherein said return circuit decides said return timing after the temperature of said catalytic convener has reached its activation temperature or higher.

14. The cylinder disabling control apparatus for a multi-cylinder engine according to claim 11, wherein said variety of sensors include a catalyst temperature sensor for detecting a temperature of said catalytic converter;

said cylinder disabling control circuit includes a return circuit for deciding return timing for returning said at least one specific cylinder from its cylinder-disabled state to a normal state in accordance with the temperature of said catalytic converter; and said return circuit decides said return timing after the temperature of said catalytic converter has reached its activation temperature or higher.

15. The cylinder disabling control apparatus for a multi-cylinder engine according to claim 11, wherein said cylinder disabling control circuit performs cylinder disabling control on two or more cylinders when the temperature of cooling water upon engine starting is equal to or higher than a second predetermined temperature which is higher than said first predetermined temperature.

16. The cylinder disabling control apparatus for a multi-cylinder engine according to claim 15, wherein said second predetermined temperature is set in accordance with a warm up temperature of said engine.

17. The cylinder disabling control apparatus for a multi-cylinder engine according to claim 16, wherein the respective cylinders of said engine are arranged on opposite banks of V type, and in case of said two or more cylinders being subjected to cylinder disabling control, said cylinder disabling control circuit decides cylinders to be disabled in such a manner that said cylinders to be disabled are distributed substantially evenly to the opposite banks of V type.

18. The cylinder disabling control apparatus for a multi-cylinder engine according to claim 16, wherein in case of said two or more cylinders being subjected to cylinder disabling control, said cylinder disabling control circuit decides the cylinders to be disabled in such a manner that said two or more cylinders to be disabled are not successively subjected to the cylinder disabling control.

19. The cylinder disabling control apparatus for a multi-cylinder engine according to claim 16, wherein in case of said two or more cylinders being subjected to cylinder disabling control, said cylinder disabling control circuit prevents a single cylinder from being successively subjected to the cylinder disabling control, by sequentially disabling said two or more cylinders.

20. The cylinder disabling control apparatus for a multi-cylinder engine according to claim 11, wherein said cylinder disabling control circuit excludes a cylinder, in which fuel is to be first fired to combust upon engine starting, at least from a specific cylinder that is first subjected to the cylinder disabling control.

21. The cylinder disabling control apparatus for a multi-cylinder engine according to claim 1, wherein said water temperature sensor is configured to detect the temperature of the cooling water before said engine is started.

22. The cylinder disabling control apparatus for a multi-cylinder engine according to claim 11, wherein said water temperature sensor is configured to detect the temperature of the cooling water before said engine is started.

* * * * *